US009719759B2

(12) United States Patent
Bergen et al.

(10) Patent No.: US 9,719,759 B2
(45) Date of Patent: Aug. 1, 2017

(54) HAPTIC FEEDBACK DEVICE FOR SIMULATOR

(71) Applicant: ARC Technology, LLC, Whitewater, KS (US)

(72) Inventors: Owen James Bergen, Wichita, KS (US); Andreas Alfred Neuber, Lubbock, TX (US); Ryan David Nord, Whitewater, KS (US); Austin Randall Patten, Wichita, KS (US); William John Carey, Whitewater, KS (US); Aaron Jay Wiebe, Whitewater, KS (US); Mark Allen Thornburg, Potwin, KS (US)

(73) Assignee: ARC Technology, LLC, Whitewater, KS (US)

( * ) Notice: Subject to any disclaimer, the term of this patent is extended or adjusted under 35 U.S.C. 154(b) by 27 days.

(21) Appl. No.: 14/858,411

(22) Filed: Sep. 18, 2015

(65) Prior Publication Data

US 2016/0084621 A1 Mar. 24, 2016

Related U.S. Application Data

(60) Provisional application No. 62/052,652, filed on Sep. 19, 2014.

(51) Int. Cl.

| | |
|---|---|
| ***F42B 8/00*** | (2006.01) |
| ***F42B 3/06*** | (2006.01) |
| ***F41A 33/04*** | (2006.01) |
| ***H05H 1/52*** | (2006.01) |
| *F41H 13/00* | (2006.01) |

(52) U.S. Cl.

CPC ..... *F42B 8/00* (2013.01); *F41A 33/04* (2013.01); *F42B 3/06* (2013.01); *H05H 1/52* (2013.01); *F41H 13/0081* (2013.01)

(58) Field of Classification Search

CPC ... F42B 8/00; F42B 3/06; F41A 33/04; H05H 1/52; F41H 13/0081

USPC ..... 102/202.7

See application file for complete search history.

(56) References Cited

U.S. PATENT DOCUMENTS

| | | | | |
|---|---|---|---|---|
| 3,136,052 A * | 6/1964 | Jean-Baptiste Ghislain Pickart | F42B 8/04 | 102/530 |
| 3,424,088 A * | 1/1969 | Gahle | F42B 8/04 | 102/293 |
| 5,351,623 A * | 10/1994 | Kissel | F42B 8/26 | 102/275.6 |
| 5,511,978 A * | 4/1996 | Sellers, Jr. | F41A 33/04 | 434/11 |
| 5,606,297 A * | 2/1997 | Phillips | F41H 13/0081 | 181/182 |
| 8,622,740 B2 * | 1/2014 | Segall | G09B 9/003 | 434/11 |

(Continued)

*Primary Examiner* — Joshua Freeman

(74) *Attorney, Agent, or Firm* — Knox Patents; Kenneth C. Spafford

(57) ABSTRACT

Haptic feedback system that simulates a detonation or explosive event. The system includes a power supply, an energy storage circuit, a switching circuit, and a conductor operatively connected to said energy storage circuit through said switching circuit whereby said conductor causes a haptic event when said energy storage circuit is electrically connected to said conductor by operation of said switching circuit. The system creates real explosions, shock waves and pressure waves in a safe manner for use in a simulator.

20 Claims, 4 Drawing Sheets

(56) References Cited

U.S. PATENT DOCUMENTS

| | | | | |
|---|---|---|---|---|
| 9,064,385 | B2 * | 6/2015 | Saboune | G08B 6/00 |
| 2003/0054322 | A1 * | 3/2003 | Sansolo | F42B 4/04 434/11 |
| 2003/0116100 | A1 * | 6/2003 | Cullen | A01K 15/02 119/719 |
| 2004/0200374 | A1 * | 10/2004 | Sansolo | F41A 33/04 102/367 |
| 2006/0162602 | A1 * | 7/2006 | Garms | F42B 4/00 102/335 |
| 2006/0166171 | A1 * | 7/2006 | Preston | F42B 8/00 434/16 |
| 2008/0280264 | A1 * | 11/2008 | Segall | G09B 9/003 434/11 |
| 2012/0188180 | A1 * | 7/2012 | Yang | G06F 3/0488 345/173 |
| 2012/0329364 | A1 * | 12/2012 | Botten | F41A 33/04 446/405 |
| 2013/0014664 | A1 * | 1/2013 | Padgett | F42B 5/313 102/439 |
| 2015/0070154 | A1 * | 3/2015 | Levesque | G06F 3/165 340/407.1 |
| 2015/0121739 | A1 * | 5/2015 | Wilson | F41A 33/04 42/90 |
| 2016/0076848 | A1 * | 3/2016 | Demaree | F41A 33/04 434/16 |
| 2016/0161747 | A1 * | 6/2016 | Osterhout | G02B 27/017 345/8 |

* cited by examiner

HAPTIC FEEDBACK DEVICE FOR SIMULATOR

CROSS-REFERENCE TO RELATED APPLICATIONS

This application claims the benefit of U.S. Provisional Application No. 62/052,652, filed Sep. 19, 2014.

STATEMENT REGARDING FEDERALLY SPONSORED RESEARCH OR DEVELOPMENT

Not Applicable.

BACKGROUND

1. Field of Invention

This invention pertains to a haptic feedback device for a simulator. More particularly, this invention pertains to devices for simulating detonation or explosive events.

2. Description of the Related Art

Haptic communication recreates the sense of touch by applying forces, vibrations, or motions to the user, for example in a virtual reality system or computer simulation. An early example is the video game Moto-Cross, where the handlebar controllers would vibrate during a collision with another vehicle. Other examples include force feedback for remote controlled robotic tools, to feel what the robot arm is "feeling"; steering wheels in virtual reality that resist turns or slip out of control during a turn; smart phone vibration in response to touch; and force magnitude and body orientation in a flight simulator.

Realistic explosions are desired in many virtual reality simulators and video games, for example, in military and rescue virtual reality training. The embodiments herein disclose safe, controlled, and realistic haptic feedback in the form of explosions, soundwaves, and shockwaves.

BRIEF SUMMARY

According to one embodiment of the present invention, a haptic generator system is provided. The haptic generator system includes a power supply, a controller, an energy storage unit, and a conductor in a driver or containment tube having a nozzle. In one such embodiment the conductor is an electro-exploding wire (EEW) array of one or more wires.

The power supply provides power for the haptic generator system and also charges the energy storage unit. The controller provides control functions for the system, including switching the capacitors in the energy storage unit to be in electrical connection with the electro-exploding wire. The energy storage unit includes one or more capacitors that are charged by the power supply. The energy storage unit also includes a switching network that connects the capacitors to the electro-exploding wire. The electro-exploding wire is a replaceable conductor that vaporizes upon application of sufficient energy. In one embodiment the wire is a single conductor. In another embodiment the wire includes multiple, independent conductors forming an array, such as for producing a rapid series of explosive events. In various embodiments the wire is carbon, nichrome, copper, aluminum, water, or other metal or conductive material. The driver is a cylindrical housing with the electro-exploding wire oriented axially at one end and with a focused air blast nozzle at the opposite end.

The energy storage unit includes one or more capacitors that are charged by the power supply. After charging the capacitors, the haptic generator system is triggerable to fire at various haptic effect power levels with no or minimal delay. Multiple switches are closed in various ways to change the number of capacitors fired in series into the output. This in turn provides options in the energy delivered to the haptic generation head. Changing the charge voltage scales these selectable haptic levels together, but that adjustment requires time to charge or discharge the energy storage capacitors to the new voltage level before firing. The controller operates the various switches that interconnect the capacitors to provide a desired voltage and current output of the energy storage unit. In one embodiment the energy storage unit includes sets of capacitors where one set is being charged while another set is delivering energy to the electro-exploding wire.

The energy storage unit provides energy to the conductor in order to create an explosive event. For the embodiment with the conductor being an electro-exploding wire, during the explosive event the electro-exploding wire is converted to plasma. The explosive event generates a shockwave and a pressure wave that simulates the visual, audio, and tactile response of a range of explosive detonations. The shockwave generated by the explosive event has spatial and temporal characteristics determined by the current pulse applied to the electro-exploding wire. Accordingly, the shockwave is tailored by the controller and energy storage unit to match a desired signature of an explosive device at desired stand-off distances.

The conversion to plasma of the electro-exploding wire array minimizes any shrapnel or environmental contaminants from the explosive event. The system does not harm the simulation facility and leaves minimal trace of its operation. In one embodiment the driver includes a screen-type shield of conductive material. The shield covers the opening of the nozzle and serves two purposes. First, the shield prevents inadvertent operator contact with potentially energized components inside the driver. Second, the shield is grounded and forms one wall of a Faraday cage to attenuate electromagnetic interference while still allowing the shock and pressure waves to propagate through the shield.

In one embodiment, the haptic generator system includes a power supply, an energy storage circuit, a switching circuit, and a wire operatively connected to said energy storage circuit through said switching circuit whereby said wire converts to plasma when said energy storage circuit is electrically connected to said wire by operation of said switching circuit. In one such embodiment the haptic generator system further includes a housing with a central bore and a nozzle positioned at one end of the housing, the wire positioned at one end of the central bore that is opposite the nozzle. In one embodiment the haptic generator system further includes a vortex generator. In one embodiment the electro-exploding wire is automatically replaceable from a spool. In one such embodiment the electro-exploding wire is suspended between a terminal end and a feed tube, the terminal end is supported inside the central bore and the feed tube is at the base of bore, in this way the wire is oriented axially with the central bore.

BRIEF DESCRIPTION OF THE SEVERAL VIEWS OF THE DRAWINGS

The above-mentioned features will become more clearly understood from the following detailed description read together with the drawings in which.

DETAILED DESCRIPTION

Apparatus for a haptic generator system 100 is disclosed. The haptic generator system is generally indicated as 100, with particular embodiments and variations shown in the figures and described below having an alphabetic suffix, for example, 100-A.

Figure 1:
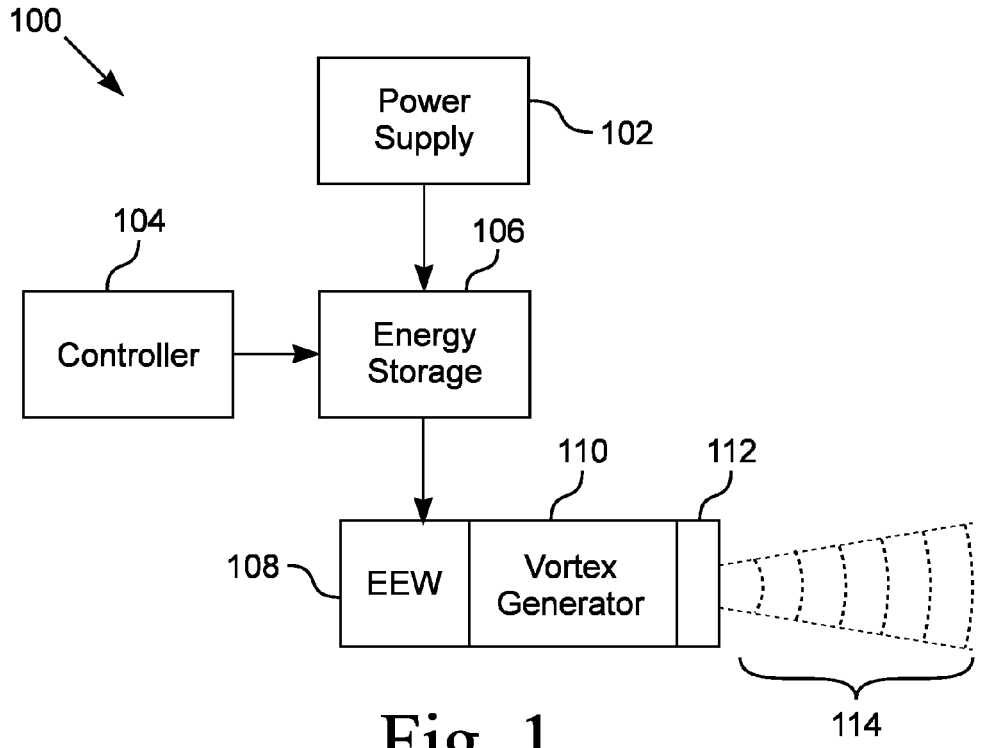
FIG. 1 is a functional block diagram of one embodiment of a haptic generator system.

FIG. 1 illustrates a functional block diagram of one embodiment of a haptic generator system 100. The system 100 includes a power supply 102, a controller 104, an energy storage unit 106, and a conductor embodied here as an electro-exploding wire (EEW) assembly 108 that is coupled to a containment tube 110 having a nozzle 112. The electro-exploding wire assembly 108 causes an explosive event 114 when it is energized by the energy storage unit 106. The explosive event 114 includes both a shockwave and a pressure wave that emanates from the nozzle 112.

In other embodiments, the conductor 108 is a stream of liquid that causes an explosive event 114 when energy from the energy storage unit 106 is applied to the stream. The feed tube 306 for the liquid is a nozzle that produces the liquid stream, where the conductor feed system 500 includes a device for propelling the stream, for example, a diaphragm pump. In other embodiments, the conductor 108 is other material responsive to an electrical charge or current, including other conductive or semi-conductive material.

The power supply 102 provides power for the system 100 and, in particular, the energy storage unit 106. The controller 104 is operatively connected to the energy storage unit 106, which is electrically connected to the electro-exploding wire assembly 108.

The explosive event 114 includes both a shockwave and a pressure wave that emanates from the nozzle 112. The shockwave and the pressure wave provide audible and physical stimuli, and the plasma flash provides a visual stimulus. For example, the pressure wave provides physical stimulus, such as with the pressure wave interacting with an observer or with the physical environment of the simulator. In this way haptic feedback is provided. The containment tube 110 and nozzle 112 focuses and shapes the emanated pressure wave from the explosive event 114 to form a focused air blast. In one embodiment the containment tube and the electro-exploding wire assembly 108 are configured as a vortex generator.

Figure 2:
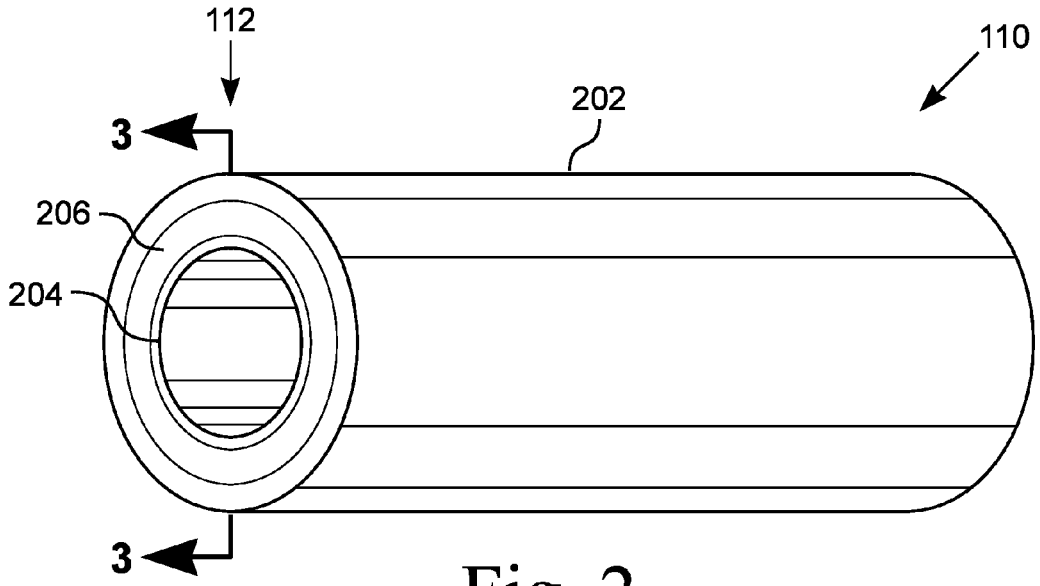
FIG. 2 is a perspective view of one embodiment of a containment tube.
Figure 3:
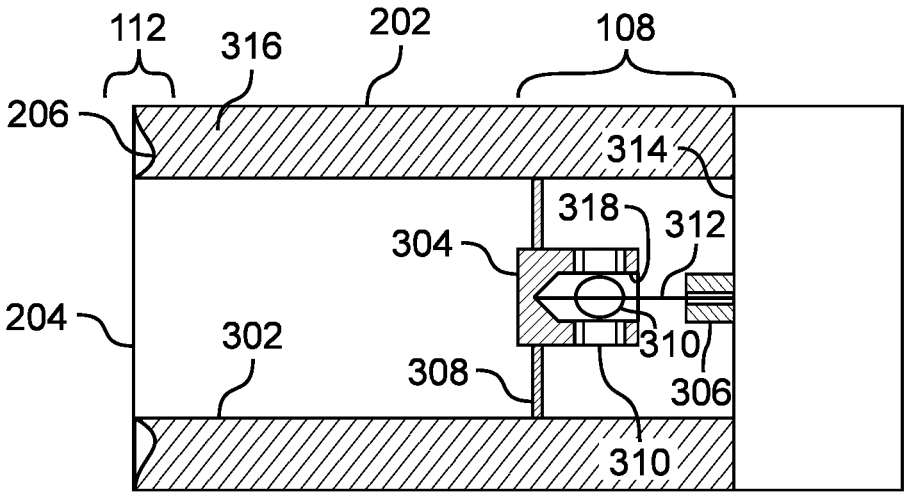
FIG. 3 is a cross-sectional view of a containment tube showing one embodiment of a electro-exploding wire assembly.
Figure 4:
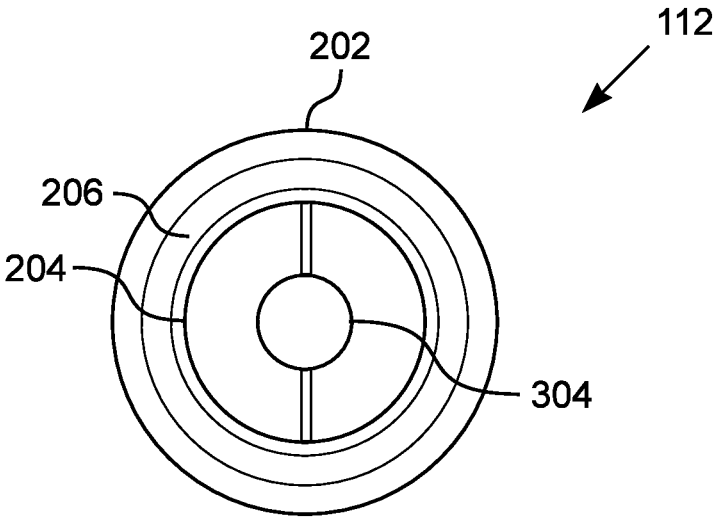
FIG. 4 is a front view of one embodiment of a nozzle end of the containment tube.

FIG. 2 illustrates a perspective view of one embodiment of a containment tube 110 with a nozzle 112. FIG. 3 illustrates a cross-sectional view of a containment tube 110 showing one embodiment of a electro-exploding wire assembly 108. FIG. 4 illustrates a front view of one embodiment of a nozzle end 112 of the containment tube 110.

The containment tube 110 is cylindrical with the electro-exploding wire assembly 108 at one end and the nozzle 112 at the opposite end. A central opening 204 at the nozzle 112 end extends into the cylindrical body 202 of the containment tube 110 with a cylindrical sidewall 302. In one embodiment the body 202 of the containment tube 110 includes a surrounding chamber 316 that provides cooling for the generator 110 after an explosive event 114. In one such embodiment the chamber 316 circulates a fluid, such as air, water, or other media suitable for heat transfer. In another such embodiment, the chamber 316 includes openings in sidewall 302 such that a negative air pressure in the chamber 316 draws particulate byproducts from an explosive event 114 out of the containment tube 110, thereby preventing contamination and/or soiling of the environment.

The electro-exploding wire assembly 108 includes terminal end 304, a pair of struts 308, a length of electro-exploding wire 312, and a feed tube 306. The struts 308 support the terminal end 304 centrally in body 202 of the containment tube 110. The illustrated embodiment shows a pair of struts 308 extending in opposed relationship to support the terminal end 304. In other embodiments the number of struts 308 varies. In each embodiment the number of struts 308 is sufficient to support the terminal end 304 during an explosive event 114.

The terminal end 304 is cylindrical and axially oriented with respect to the bore 204 in the body 202. The terminal end 304 has a cylindrical bore 318 parallel with the outer cylindrical surface of the terminal end 304. The cylindrical bore 318 is a blind bore that has an inside end that is conical. In the illustrated embodiment the terminal end 304 includes a series of openings 310 between the outer cylindrical surface and the cylindrical bore 318. Those skilled in the art will recognize that the terminal end 304 has a configuration that aids in receiving the wire 312 without unduly restricting the plasma from an explosive event. The electro-exploding wire 312 extends into the cylindrical bore and is seated against the inside point of the conical end, thereby making an electrical connection between the terminal end 304 and the electro-exploding wire 312. In one embodiment at least one of the struts 308 is conductive and provides an electrical pathway to connect to the electro-exploding wire 312 where it contacts the inside point of the conical end.

The terminal end 304 also includes a series of openings in the cylindrical sidewalls. These openings are configured to allow the expanding plasma from the electro-exploding wire 312 to escape the terminal end 302 in a manner that allows the plasma to form a shockwave in a predetermined form and direction.

Extending from the inside end 314 of the body 202 is a feed tube 306 with the electro-exploding wire 312 extending from the feed tube 306 into the terminal end 304. The wire 312 extends axially relative to the sidewalls 302 from the feed tube 306 to the terminal end 304.

Opposite the electro-exploding wire assembly 108 is the nozzle 112. In the illustrated embodiment the nozzle 112 is a focused air blast nozzle. The nozzle 112 focuses the sound pressure wave to a smaller area compared to the containment tube 110 without the nozzle 112. The nozzle 112 has an outer surface 206 that is arcuate and functions to isolate and separate the emitted pressure wave from the ambient air.

Figure 5:
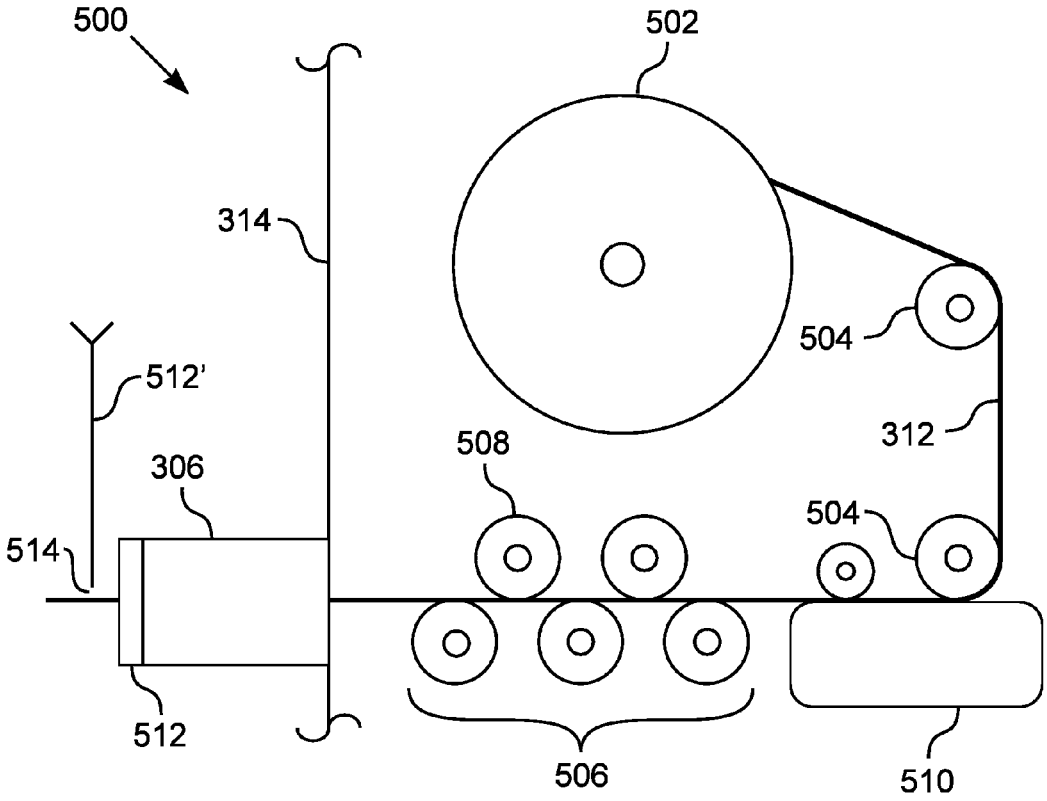
FIG. 5 is a symbolic view of one embodiment of an automatic electro-explosive wire feed assembly.

FIG. 5 illustrates a symbolic view of one embodiment of a conductor feed system 500, which is illustrated as an automatic electro-explosive wire feed assembly 500. In one embodiment the haptic generator system 100 is a one-shot device. In such an embodiment the electro-exploding wire 312 must be manually replaced after each explosive event 114. In the illustrated embodiment the haptic generator system 100 is a multi-shot device, that is, the electro-exploding wire 312 is automatically replaced after each explosive event 114 without requiring operator intervention.

In the illustrated embodiment of the automatic electro-explosive wire feed assembly 500 a spool 502 provides a supply of electro-explosive wire 312. The wire 312 is routed through idler wheels 504 to the wire drive 510. The wire drive 510 includes a capstan that pulls the wire 312 from the spool 502 and forces it through straightening mechanism 506 which in this embodiment comprises a series of straightening wheels 508. After the wire 312 is straightened it is fed through the feed tube 306 where the wire 312 is forced into the terminal end 304. In other embodiments the configuration of the spool 502, idler wheels 504, wire drive 510, and straightening mechanism 506 varies. For example, in a different embodiment the wire drive 510 and corresponding idler wheels 504 are located subsequent to the straightening mechanism 506 and thus the wire drive 510 pulls the wire 312 through the straightening mechanism 506. The wire 312 passing through the feed tube 306 is sufficiently straight that it is readily feed into the terminal end 304.

The electro-exploding wire 312 is an electrical circuit element. With the application of sufficient voltage and current from the energy storage unit 106 the electro-exploding wire 312 will vaporize. The portion of the wire between the terminal end 304 and the feed tube 306 is the portion desired to be volatized for an explosive event 114. Accordingly, the energy storage device electrically connects to the wire 312 through the terminal end 304 and the feed tube 306. In one embodiment the outboard tip 512 (relative to the inside end 314 of the body 202) of the feed tube 306 is conductive and it is the tip 512 that makes electrical contact with the wire 312. Also illustrated in FIG. 5 is another embodiment of an electrode 512' positioned adjacent the outboard tip 512 of the feed tube 306, The end of the electrode 512' is separated from the wire 312 by a spark gap 514. Upon being energized, a spark completes the circuit between the electrode 512' and the wire 312, thereby allowing the wire 312 to vaporize between the spark gap 514 and the terminal end 304. In this way the portion of the wire 312 that vaporizes is external to the feed tube 306, thereby ensuring that the wire 312 remains free to pass through the feed tube 306 without being fused to the feed tube 306.

In another embodiment, the conductor feed system 500 replenishes the stream of liquid used as the conductor 108. In such an embodiment the feed tube 306 is a nozzle that directs a stream of liquid to the terminal end 304. The feed system 500 includes a device, such as a pump, for forcing the liquid through the nozzle 306. The liquid is forced through the nozzle 306 immediately before the controller 104 initiates application of energy to the stream of liquid. In another embodiment, the stream of liquid is continuous while the system is running and the feed system 500 does not change liquid output based on whether the controller 104 is about to initiate application of energy to the stream of liquid.

Figure 6:
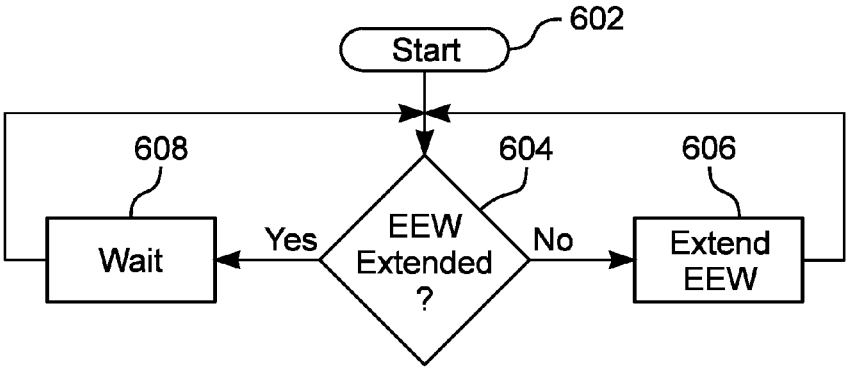
FIG. 6 is a flow diagram of one embodiment of the operation of the automatic electro-explosive wire feed assembly.

FIG. 6 illustrates a flow diagram of one embodiment of the operation of the automatic electro-explosive wire feed assembly 500. The EEW feed assembly 500 operates continuously after it starts 602. The assembly 500 includes a sensor that detects if the electro-explosive wire 312 is fully extended. The first step 604 is to determine if the electro-explosive wire 312 is fully extended. If it is not fully extended, then the next step 606 is to drive the motor assembly 510 to advance the wire 312. The position is checked again 604 and the steps 604, 606 repeat until the wire 312 is fully extended. If the electro-explosive wire 312 is fully extended, then the next step 608 is to wait until there is an explosive event. Such an event requires that the wire 312 be advanced such that it fully extends again.

Figure 7:
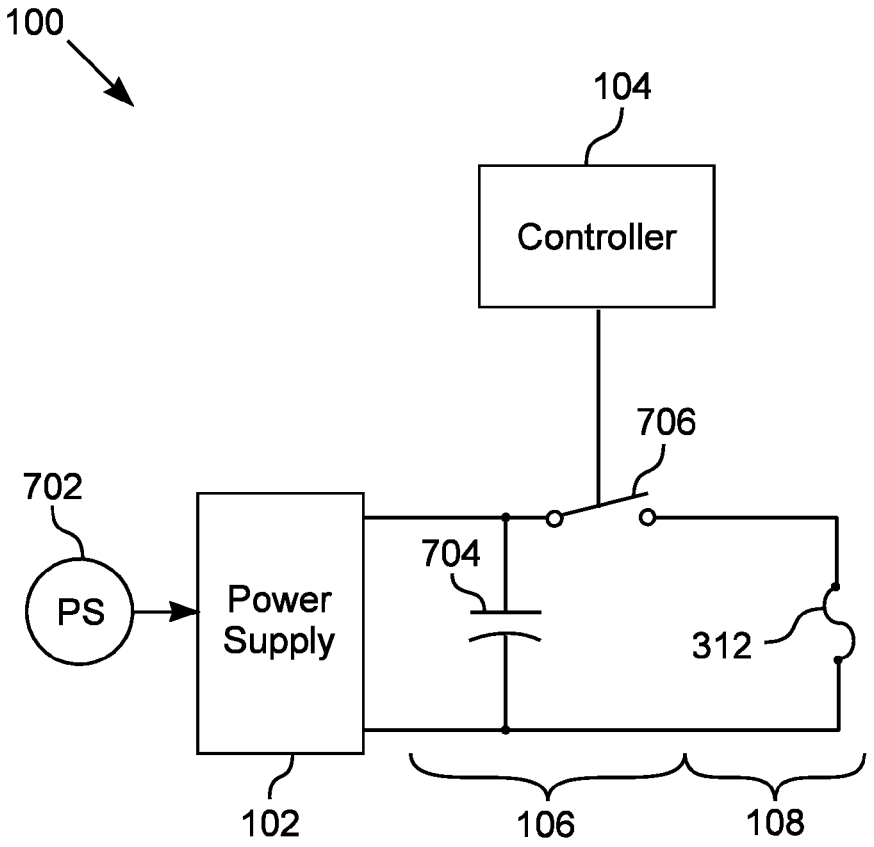
FIG. 7 is a simplified schematic diagram of the haptic generator system.

FIG. 7 illustrates a simplified schematic diagram of the haptic generator system 100. The power supply 102 is fed from a power source 702, such as the mains or a battery.

The energy storage unit 106 includes an energy storage circuit and a switching circuit. In the illustrated embodiment the energy storage circuit includes a capacitor 704 and the switching circuit includes a switch 706. In other embodiments the energy storage unit 106 includes multiple capacitors 704 and/or switches 706. The controller 104 is operatively connected to the switches 706 in the energy storage unit 106.

The power supply 102 provides power to charge the energy storage unit 106. The power supply 102 includes a high voltage supply that, for example, operates between 1 to 2 kV dc and charges the capacitor 704. In one embodiment the power supply 102 is current limited such as with a resistor in series with the capacitor 704. In this way the capacity of the power supply 704 will not be exceeded.

The illustrated energy storage unit 106 has a capacitor 704 of 400 μF. The power supply 102 charges the capacitor 704 up to 2 kV (800 J). The energy storage unit 106 has a switch 706 rated to make a connection that carries such high energy. In one embodiment the switch 706 is a thyratron switch. In another embodiment the switch 706 is a high energy relay. Such a switch 706 has a high speed of operation in order to minimize pre-contact arcing. The switch 706 is also rated to carry the energies used to cause the electro-exploding wire 312 to vaporize.

The electro-exploding wire 312 is a conducting element that vaporizes when exposed to high current. In various embodiments the wire 312 is made of carbon, nichrome, copper, aluminum, doped water, or other metal or conductive material. A wire 312 made of carbon forms carbon dioxide after an explosive event 114.

In one embodiment the electro-exploding wire 312 is a thin metal wire with 286 μm diameter. In such an embodiment the capacitor 704 with a 2 kV charge applies approximately 10 kA within about 100 microseconds and the resulting explosive event 114 generates a pressure wave with overpressures on the order of 1 psi (6.9 kPa). Increasing the voltage applied to the wire 312 in this embodiment increases the sound pressure level of the explosive event 114.

The electro-explosive wire 312 generates an explosive event 114 with results similar to the detonation of high explosives. The resistive heating of the wire 312 vaporizes the wire 312 and generates plasma that is then expanded by the driving current. The expanding plasma cloud compresses the surrounded gas and generates a shockwave that propagates faster than the plasma itself. The expanding plasma cools quickly once the stored energy dissipates. The surrounding air aids in the cooling process and reacts with the metal vapor in the plasma to form non-conductive particulates, such as aluminum oxide for an aluminum wire 312. These particulates, in one embodiment, are drawn from the bore 204 and filtered, thereby preventing any soiling or contamination of the surrounding environment.

FIG. 7 illustrates a simplified schematic of one embodiment of a haptic generator system 100. The simplified schematic does not illustrate various components and connections, for example, power and ground connections to the various components and a discharge resistor to remove the residual charge on the capacitor 704. However, those skilled in the art will recognize the need for such components and wiring and understand how to construct such a circuit, based on the components ultimately selected for use.

Figure 8:
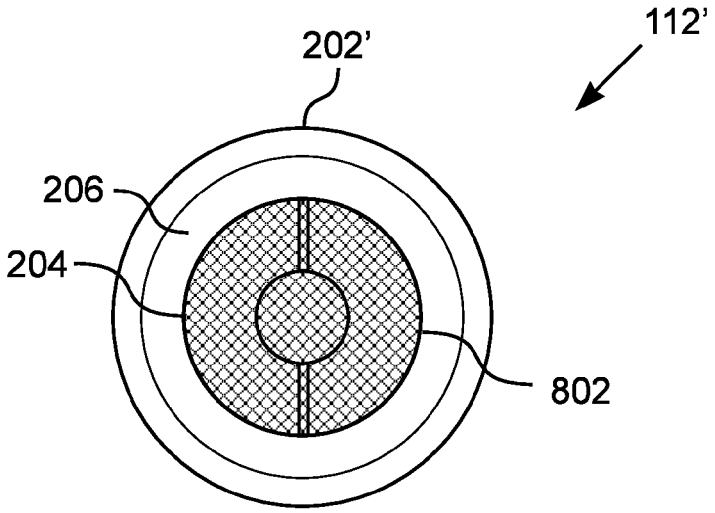
FIG. 8 is a front view of a second embodiment of a nozzle end of the containment tube.

FIG. 8 illustrates another embodiment front view of a nozzle end 112' with a conductive shielding 802 placed between the nozzle central opening 204 and terminal end 306. The body 202' contains sufficient conductive material such that the conductive shielding 802 is grounded to the body 202' to create a Faraday cage that prevents outside EMF interference with the containment tube 108 and nozzle 112. The shielding 802 also acts as a safety screen to prevent users from inadvertently coming into contact with high voltages and currents.

While the present invention has been illustrated by embodiments that have been described in considerable detail, it is not the intention of the applicant to restrict or in any way limit the scope of the appended claims to such detail. Additional advantages and modifications will readily appear to those skilled in the art. The invention in its broader aspects is therefore not limited to the specific details, representative apparatus and methods, and illustrative examples shown and described. Accordingly, departures may be made from such details without departing from the spirit or scope of applicant's general inventive concept.

What is claimed is:

1. An apparatus for a haptic generator that through an explosion causes an event that includes a pressure wave and a shock wave, said apparatus comprising:

a conductor configured to produce the explosion when a specified energy level is applied to said conductor;

a vortex generator having a first end and a second end opposite said first end, wherein said conductor is proximate said first end, and wherein said second end has an opening; and a controller configured to selectively apply said specified energy level to said conductor.

2. The apparatus of claim 1, wherein said conductor is a wire comprised of metal and oriented parallel with a center axis of said opening.

3. The apparatus of claim 1, further comprising:

a terminal end supported inside said opening;

wherein said conductor is suspended between said terminal end and said first end of said vortex generator.

4. The apparatus of claim 3, wherein said terminal end has a central blind bore with a closed end, and wherein said conductor is suspended between a feed tube and said closed end.

5. The apparatus of claim 4, wherein said terminal end is interposed between at least a portion of said conductor and said opening.

6. The system of claim 3, wherein said terminal end includes a series of apertures extending from said central blind bore to an outside of said terminal end.

7. The apparatus of claim 1, further including a conductor feed assembly configured to replace said conductor after the event.

8. The apparatus of claim 7, wherein said conductor feed assembly includes a wire feed mechanism configured to feed said conductor to a terminal end inside said vortex generator, said wire feed mechanism includes a wire straightener.

9. The apparatus of claim 1, whereby said conductor is configured to explode when said specified energy level is applied to said conductor.

10. The apparatus of claim 1, further comprising a conductive screen between said opening and said conductor, wherein said vortex generator includes conductive material that is electrically coupled to said screen such that said conductive screen and conductive material collectively form a Faraday cage.

11. The apparatus of claim 1, further comprising a cooling jacket thermally coupled to said vortex generator.

12. The apparatus of claim 1 wherein said vortex generator includes a cylinder, said first end being substantially closed and said second end defining said opening.

13. A haptic event apparatus, said apparatus comprising:

an energy storage unit;

a container having an opening at a first end;

a conductor inside said container and opposite said first end, wherein said conductor is operatively connected to said energy storage unit; and a controller operatively coupled to said energy storage unit and configured to control an amount of energy delivered to said conductor from said energy storage unit;

whereby said conductor causes an event that includes a pressure wave and a shock wave when said energy storage unit is electrically connected to said conductor by operation of said controller.

14. The apparatus of claim 13, whereby a pressure wave and shock wave exit said container when said conductor causes said event.

15. The apparatus of claim 13, further comprising a nozzle located proximate said opening, wherein said nozzle is configured to control the trajectory of said pressure wave and shock wave.

16. The apparatus of claim 13, further including a conductor feed assembly configured to replace said conductor after said event.

17. A haptic event apparatus, said apparatus comprising:

an energy storage unit;

a controller operatively connected to said energy storage unit;

a container having an opening at one end;

a conductor inside said container, wherein said conductor is operatively connected to said energy storage unit; and a terminal end inside said container interposed between said conductor and said container opening, wherein said conductor causes an event when said energy storage unit is electrically connected to said conductor by operation of said controller, such that a pressure wave and a shock wave exit said container when said event occurs.

18. The haptic event apparatus of claim 17, wherein said conductor is electrically coupled to said terminal end.

19. The haptic feedback system of claim 17, wherein said conductor is at least partially inside a blind bore that is inside said terminal end, and wherein said terminal end includes multiple openings extending from said blind bore to the outside of said terminal end, and wherein none of said multiple openings are angled toward said nozzle.

20. The haptic event apparatus of claim 17, further comprising a conductive screen, wherein said conductive screen is in between said container opening and said conductor, and wherein said screen is conductively coupled to said container such that said container and said screen form a Faraday cage.

* * * * *